US006234643B1

(12) United States Patent
Lichon, Jr.

(10) Patent No.: US 6,234,643 B1
(45) Date of Patent: May 22, 2001

(54) LAY-IN/RECESSED LIGHTING FIXTURE HAVING DIRECT/INDIRECT REFLECTORS

(76) Inventor: Joseph F. Lichon, Jr., 215 B 9th Ave., Belmar, NJ (US) 07719-2303

( * ) Notice: Subject to any disclaimer, the term of this patent is extended or adjusted under 35 U.S.C. 154(b) by 0 days.

(21) Appl. No.: 09/387,464

(22) Filed: Sep. 1, 1999

(51) Int. Cl.[7] ..... F21V 11/06

(52) U.S. Cl. ..... 362/147; 362/290; 362/291; 362/147; 362/240; 362/237; 362/241; 362/247; 362/260; 362/364; 362/342

(58) Field of Search ..... 362/290, 291, 362/147, 240, 237, 241, 247, 260, 364, 342

(56) References Cited

U.S. PATENT DOCUMENTS 4,268,897 * 5/1981 Schierwagen et al. ..... 362/325
5,008,791 * 4/1991 Caferro ..... 362/290
6,139,169 * 10/2000 Caferro ..... 362/291

* cited by examiner

*Primary Examiner*—Thomas M. Sember
*Assistant Examiner*—Anabel Ton
(74) *Attorney, Agent, or Firm*—Ezra Sutton

(57) ABSTRACT

A lighting fixture for reducing glare and darkspots on ceilings and walls. The lighting fixture includes a louver housing for supporting a plurality of fluorescent or high intensity discharge lamps. The lighting fixture further includes a first set of elongated, parallel, and spaced-apart reflectors; and a second set of elongated, parallel, and spaced-apart reflectors intersecting the first set of reflectors at a 90° degree angle for forming an open reflector grid therein. The open reflector grid includes four outer side walls. The open reflector grid is attached to the louver housing. The open parabolic reflector grid extends at least two inches (2") below the ceiling level. The lighting fixture also includes a plurality of indirect reflectors connected to the four outer side walls of the open reflector grid for reducing glare and darkspots on ceiling and walls caused by the plurality of fluorescent lamps in the louver housing. Each one of the outer side walls is connected to one of the indirect reflectors thereto.

19 Claims, 8 Drawing Sheets

LAY-IN/RECESSED LIGHTING FIXTURE HAVING DIRECT/INDIRECT REFLECTORS

FIELD OF THE INVENTION

This invention relates to a lay-in/recessed lighting fixture that provides for multi-focus (direct and indirect) lighting to a ceiling, walls and a floor within a room, using straight, curved, segmented, stippled or parabolic reflectors having direct/indirect reflectors thereon. More particularly, the direct/indirect reflectors provide for a reduction in glare, give more even lighting and an elimination of shadows on walls and the ceiling within a room.

BACKGROUND OF THE INVENTION

Lay-in/recessed lighting fixtures having parabolic reflector louvers for direct room lighting and pendant mounted suspended fixtures having indirect or direct/indirect distribution are well known in the art. These types of lighting fixtures have one or more of the following disadvantages with their use:

1. An uneven illumination of light within a room which produces a cave or shadow effect and darkspots on the walls and ceiling of the room;
2. A glare effect caused by the direct and/or indirect fluorescent lighting off of the reflected surface;
3. This glare effect causes eye strain on the computer operator as the light reflects off of the video display terminal (VDT) on a computer monitor;
4. These lay-in/recessed parabolic lighting fixtures use a deep recess depth and conflict with HVAC ducting which takes a lot of space in the ceiling cavity or plenum above the lighting fixtures;
5. These lighting fixtures have high energy consumption levels;
6. These pendant mounted lighting fixtures have high installation costs; and
7. These parabolic lighting fixtures decrease work productivity as the light from the fixtures cause eye strain and headaches as the user's eyes are continually focusing and defocusing because of the contrast between high illuminance on horizontal and low vertical planes and low illuminance on ceilings and high vertical planes.

There remains a need for a direct/indirect lighting fixture that provides multi-focus lighting to walls, ceiling and floor areas within a room using straight, curved, segmented, stippled or parabolic reflectors having indirect reflectors thereon. Additionally, the indirect reflectors will provide for a uniformity of illumination within a room by eliminating darkspots and shadow effects to the room and reducing glare of the fluorescent lamps within the lighting fixture.

DESCRIPTION OF THE PRIOR ART

Lighting fixtures having straight, curved or parabolic reflectors within a louvered grid of various designs, styles and materials of construction have been disclosed in the prior art.

For example, U.S. Pat. No. 5,272,607 discloses a lighting fixture suspendable from a ceiling with two fixture parts. A reflector is placed above the fixture parts so that upwardly radiating light is downwardly directed by the reflector. The glass reflector may be slightly concave or parabolic. The light gets reflected primarily obliquely and downwardly to provide direct downlight in a non-glaring manner. This prior art patent does not disclose a lighting fixture having indirect reflectors thereon.

U.S. Pat. No. 4,344,111 discusses a lighting fixture using eight curved reflectors surrounding a light bulb, to allow the upward projection of light for downward reflection from a ceiling onto a work area or work surface below. The eight interrelated curved reflectors include two side segments, two end segments, and four corner segments. The light is reflected in a generally circular pattern of even intensity. The unit can also be used to project light downwardly or horizontally, if desired. This prior art structure is different than the structure of the present invention of a lighting fixture having direct/indirect reflectors thereon.

U.S. Pat. No. 4,751,626 discloses first and second reflectors which each possess reflecting surfaces that are parabolic. A cross baffle is placed above and between the reflectors to prevent bright spots above the cut-off angle of light being projected. This patent does not disclose the structure or features of the present invention of a lighting fixture having direct/indirect reflectors thereon for giving off upwardly radiating light combined with downlighting.

None of the aforementioned prior art patents disclose the lighting fixture of the present invention having direct/indirect reflectors thereon for reducing glare and eliminating darkspots on walls and the ceiling of a room, and for providing more uniform room illumination.

Accordingly, it is an object of the present invention to provide a lay-in/recessed lighting fixture that gives multi-focus (direct and indirect) lighting to a ceiling, a floor and walls within a room using straight, curved, segmented, stippled or parabolic reflectors having direct/indirect reflectors thereon.

Another object of the present invention is to provide a lay-in/recessed lighting fixture having direct/indirect reflectors thereon for reducing energy consumption, for increasing lighting efficiency and for further reducing systems installation costs.

Another object of the present invention is to provide a lay-in/recessed lighting fixture having direct/indirect reflectors thereon that produces uniform lighting within a room.

Another object of the present invention is to provide a lay-in/recessed lighting fixture having direct/indirect reflectors thereon that eliminates a cave or shadow effect and/or darkspots on the walls, ceiling or floor of a room.

Another object of the present invention is to provide a lay-in/recessed lighting fixture having direct/indirect reflectors thereon that reduces the glare effect caused by the direct and indirect lighting of the fluorescent lamps from conventional parabolic reflectors and indirect pendant mounted light fixtures.

Another object of the present invention is to provide lay-in/recessed fixture having direct/indirect reflectors thereon for increasing work productivity by eliminating the glare on VDT of computer monitors which reduces eye strain and headaches due to the continually focusing and defocusing of the user's eyes on the VDT screen via the cut-off angles and uniformity of the reflective (indirect) light that is given off by the indirect reflectors.

Another object of the present invention is to provide a lay-in/recessed lighting fixture having direct/indirect reflectors thereon that reduces purchase costs over pendant mounted indirect or direct/indirect lighting fixtures.

Another object of the present invention is to provide a lay-in/recessed lighting fixture having direct/indirect reflectors thereon that reduces plenum depth encroachment, as current HVAC systems utilize a large portion of the above ceiling space which conflicts with conventional lighting fixture placement within the ceiling space area.

Another object of the present invention is to provide a lay-in/recessed lighting fixture having direct/indirect reflectors thereon that is compatible with the latest technology in lamp and ballast combinations using tubular fluorescent lamps such as T-8/magnetic and electronic; T-5/electronic; bi-axial/magnetic and electronic; compact fluorescent/magnetic and electronic; circular fluorescent/magnetic and electronic; and high intensity discharge/magnetic and electronic.

A further object of the present invention is to provide a lay-in/recessed lighting fixture having direct/indirect reflectors thereon that can be mass produced in automated and economical manner, and is cost efficient for the user.

SUMMARY OF THE INVENTION

In accordance with the present invention, there is provided a lighting fixture for reducing glare and darkspots on ceilings and walls. The lighting fixture includes a louver housing for supporting a plurality of fluorescent or high intensity discharge lamps.

The lighting fixture further includes a first set of direct focusing, elongated, parallel, and spaced-apart reflectors; and a second set of elongated, parallel, and spaced-apart reflectors intersecting the first set of reflectors at a 90° degree angle for forming an open reflector grid therein. The open parabolic reflector grid includes four outer side walls. The open reflector grid is attached to the louver housing. The open reflector grid extends at least two inches (2") below ceiling level.

The lighting fixture also includes a plurality of indirect focusing reflectors connected to the four outer side walls of the open reflector grid for reducing glare and darkspots on ceiling and walls caused by the plurality of fluorescent lamps in the louver housing. Each one of the outer side walls is connected to one of the indirect reflectors thereto.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 7:
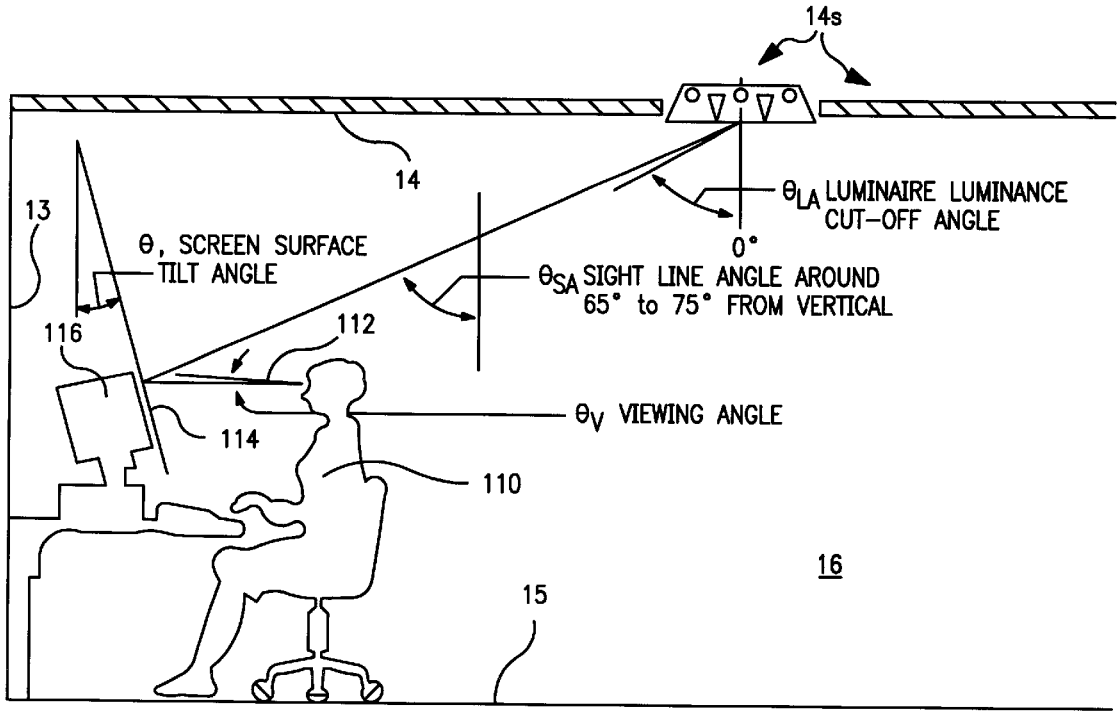
FIG. 7 PRIOR ART
FIG. 7 is a schematic diagram of a standard parabolic lighting fixture of the prior art showing line of sight off of a video display terminal (VDT) on a computer monitor to a computer operator using conventional parabolic reflectors off of the parabolic lighting fixture.
Figure 8:
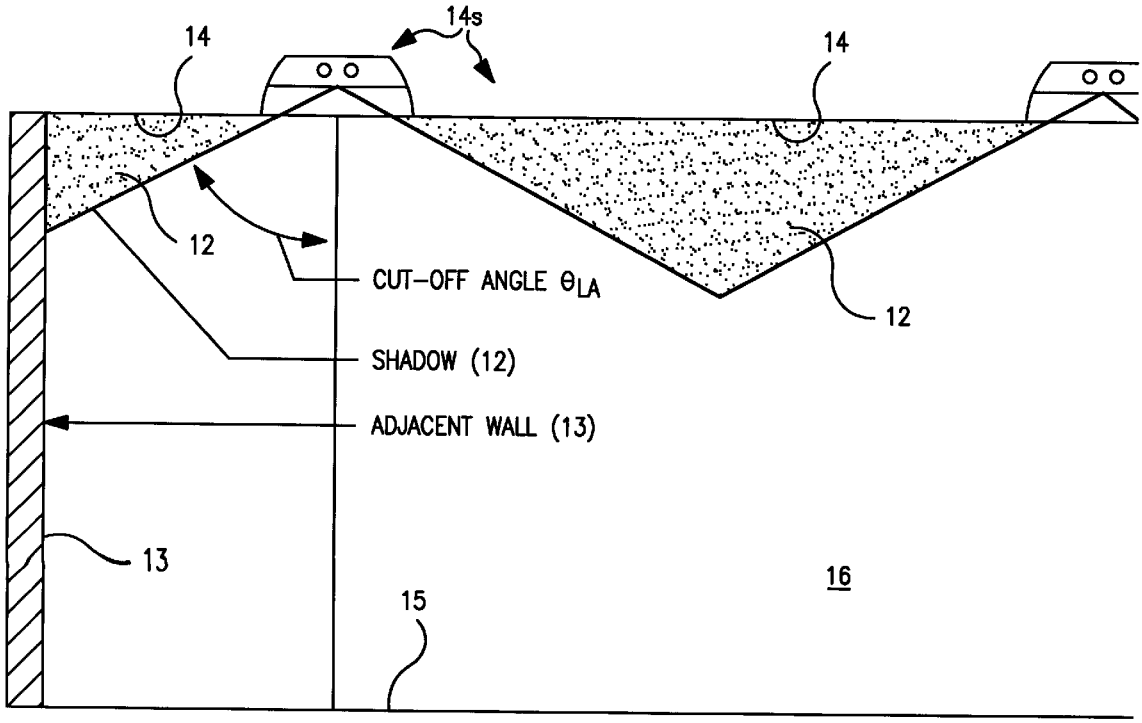
FIG. 8 PRIOR ART
FIG. 8 is a schematic diagram of a standard parabolic lighting fixture of the prior art showing wall and ceiling shadows using conventional parabolic reflectors on the parabolic lighting fixture.

The parabolic lighting fixture 10 and its component parts of the preferred embodiment of the present invention are represented in detail by FIGS. 1 through 6 and 9 through 12 of the patent drawings. The prior art of parabolic lighting fixtures are depicted in FIGS. 7 and 8 of the drawings. The lay-in/recessed lighting fixture 10 shown in FIG. 3 has indirect reflectors 90*a* to 90*d* thereon, for reducing glare; eliminating shadows/darkspots 12 on walls 13, the ceiling 14 and the floor 15 within a room 16; and for providing more uniform illumination in room 16 by reflecting the light rays 18 from the fluorescent lamp assemblies 40*a* to 40*c* in a more efficient manner.

Figure 6:
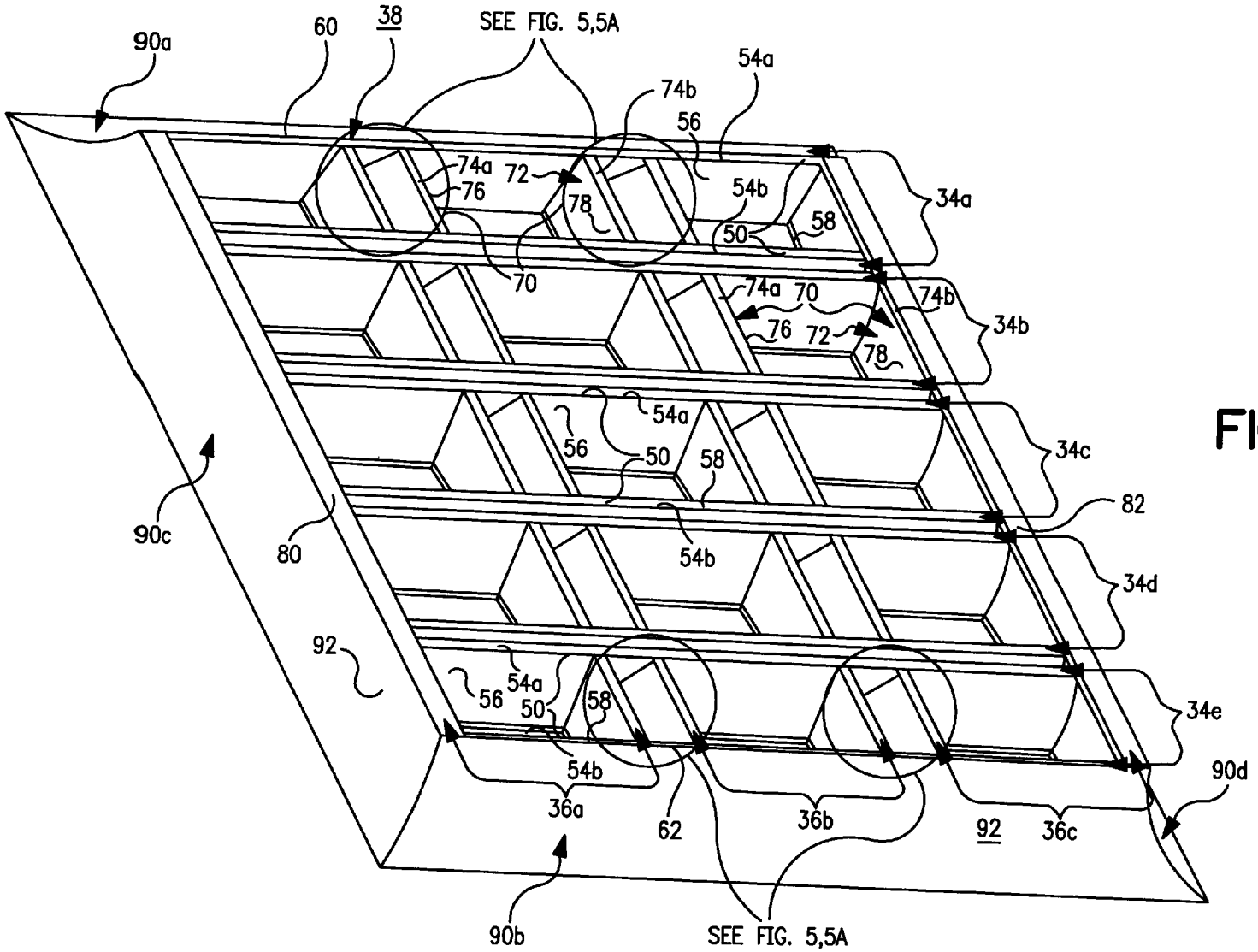
FIG. 6 is a rear perspective view of the lighting fixture of the present invention showing the plurality of indirect reflectors connected to the outer side walls of the open reflector grid.

The lay-in/recessed lighting fixture 10 includes a louver housing/ballast compartment 20, a rectangular back pan 22, a first set of elongated, parallel and spaced-apart reflector pairs 34*a* to 34*e*, and a second set of elongated, parallel and spaced-apart reflector pairs 36*a* to 36*c* intersecting the first set of reflector pairs 34*a* to 34*e* at a 90° degree angle for forming an open reflector grid 38 therein, as depicted in FIG. 6 of the patent drawings.

Figure 3:
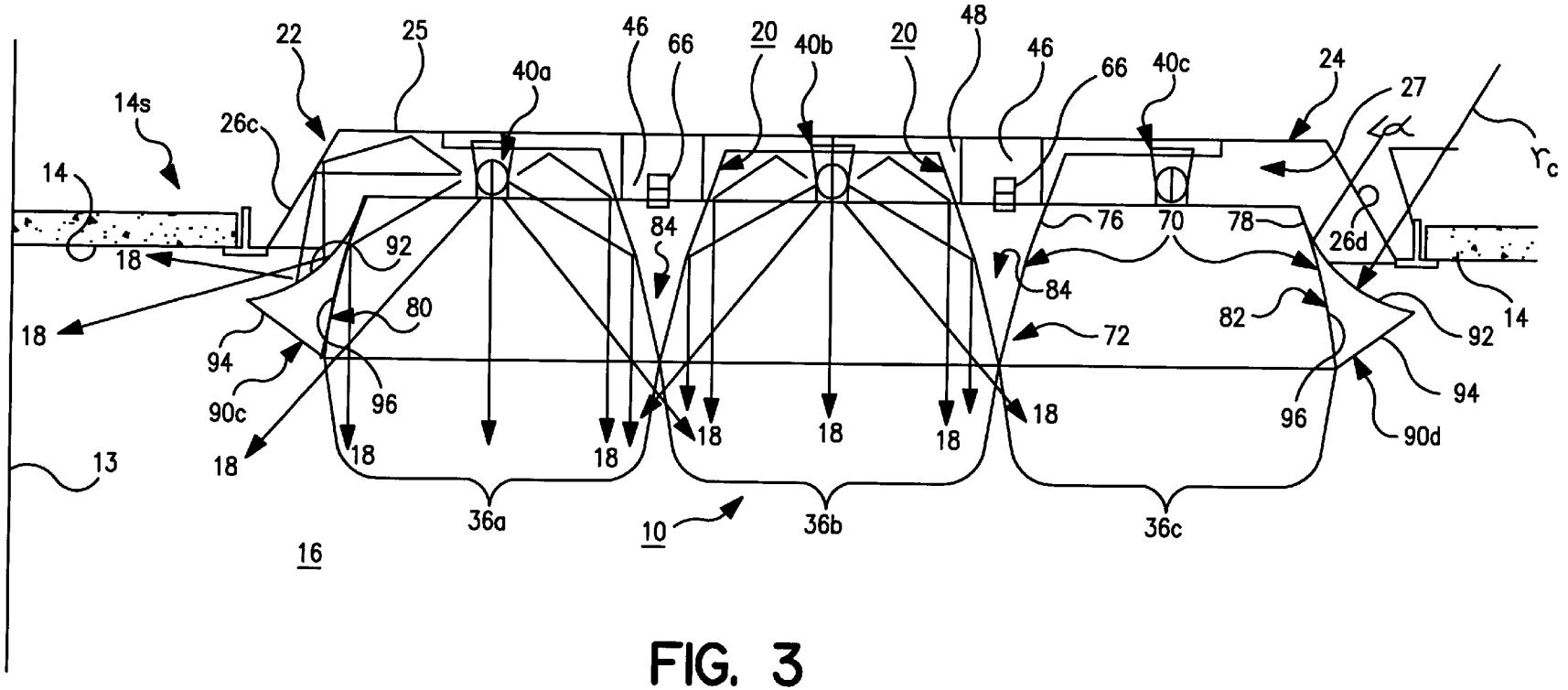
FIG. 3 is a cross-sectional view of the lighting fixture of the present invention taken along lines 3—3 of FIG. 2 showing the louver housing, the lamp ballasts, the fluorescent lamps, and the reflectors having direct/indirect reflectors thereon.
Figure 4:
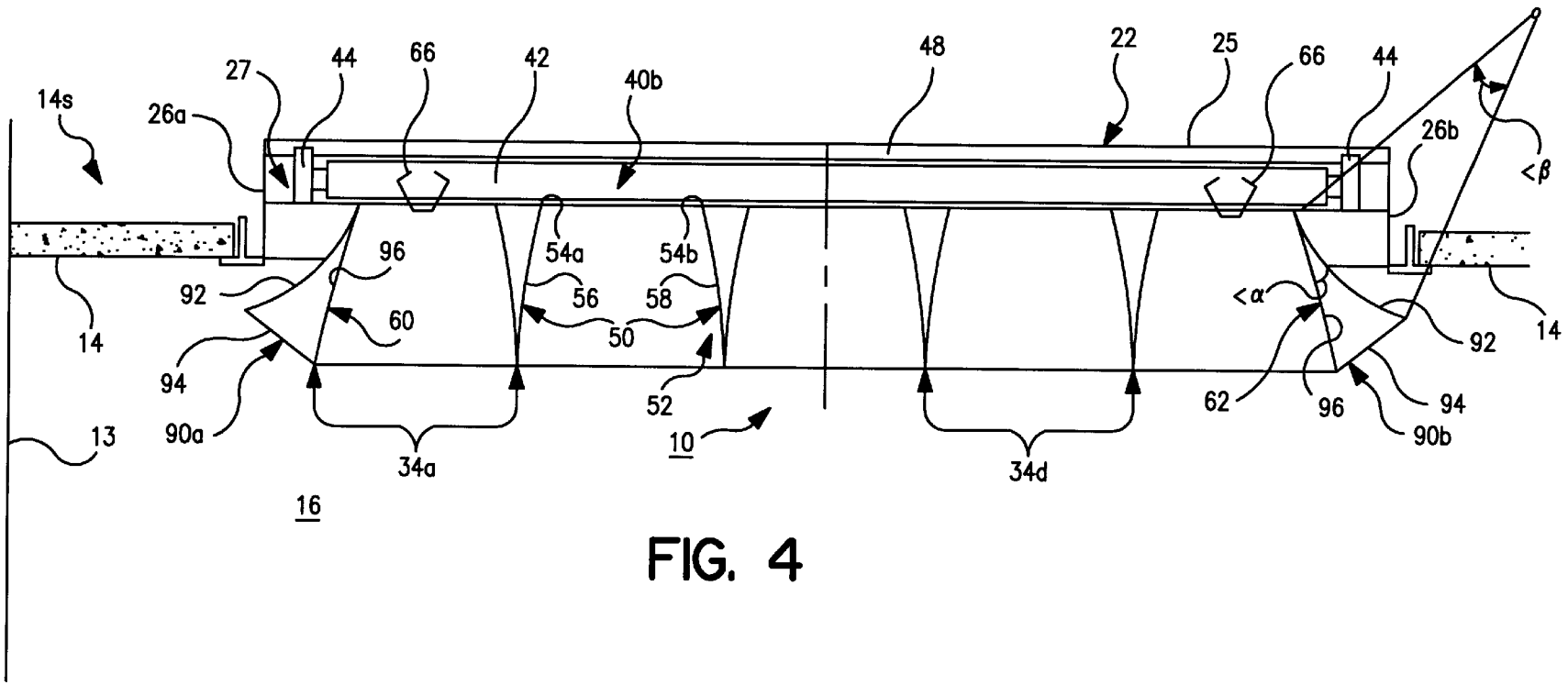
FIG. 4 is a cross-sectional view of the lay-in/recessed lighting fixture of the present invention taken along lines 4—4 of FIG. 2 showing the louver housing, the lamp ballasts, the fluorescent lamp, and the reflectors having direct/indirect reflectors thereon.

The lay-in/recessed lighting fixture 10 also includes a plurality of fluorescent lamp assemblies 40*a* to 40*c* connected to the ballast housing 20, and a plurality of indirect reflectors 90*a* to 90*d* connected to the outer side walls 60, 62, 80 and 82, respectively, of the open reflector grid 38, as shown in FIGS. 3, 4 and 6 of the patent drawings.

The first set of reflector pairs 34*a* to 34*e* each include a reflector unit 50 having a reflector housing 52. Each reflector housing 52, as depicted in FIGS. 2, 3, 4 and 6, includes top perimeter walls 54*a* and 54*b*, a pair of convex-shaped side walls 56 and 58, respectively. Perimeter walls 54*a* and 54*b* include a plurality of connecting cross-bar members 64 for joining and connecting adjacent top perimeter walls 54*b* and 54*a*, respectively, of adjacent reflector pairs 34*b*, 34*c* and 34*d*, respectively, as shown in FIGS. 5 and 6.

Additionally, connecting cross-bar members 64 includes an attached centering pin 65, and an attached torsion spring 66 or torsion clip 66' , wherein centering pin 65 and torsion spring 66 or torsion clip 66' are received within the centering hole opening 28 and torsion slot opening 30, respectively, of the bottom walls 24 of ballast housing 20. Centering pins 65 and torsion springs 66 are used to connect and mount the first set of reflectors 36*a* to 36*c* and 34*a* to 34*e* to the ballast housing(s) 20, as depicted in FIGS. 2, 3, 4, 5 and 5A of the drawings.

Figure 5:
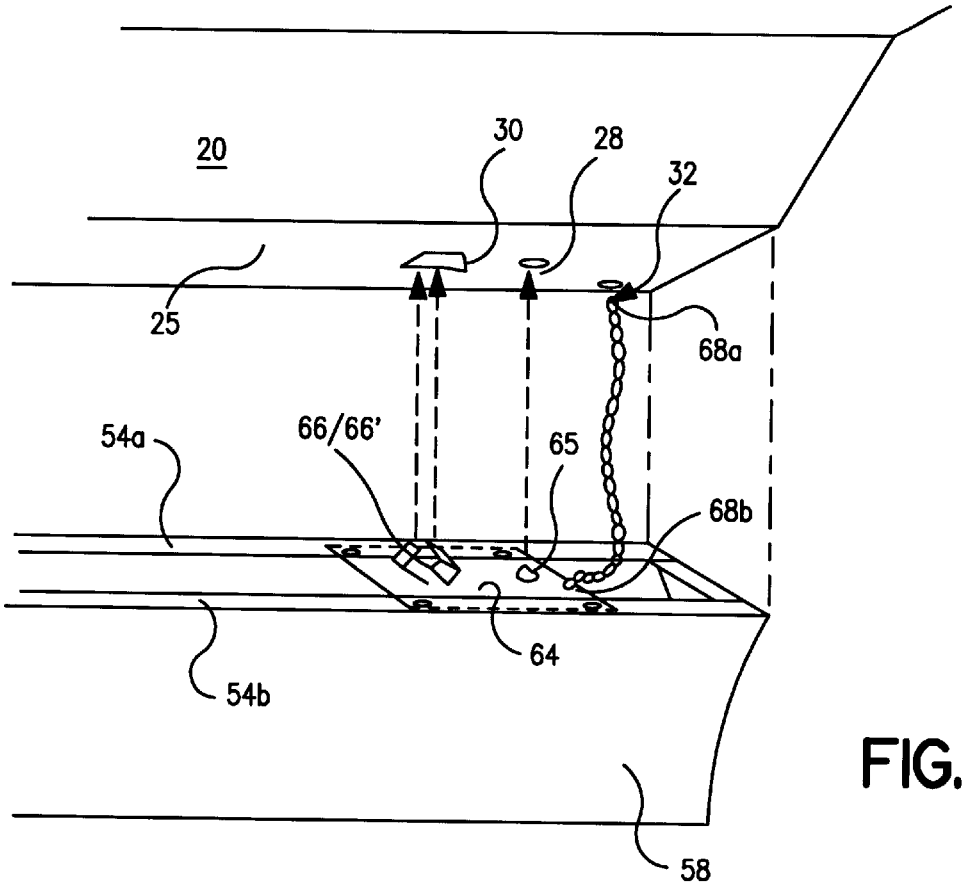
FIG. 5 is an exploded view of the lighting fixture of the present invention showing the reflector being attached to the ballast housing.
Figure 5A:
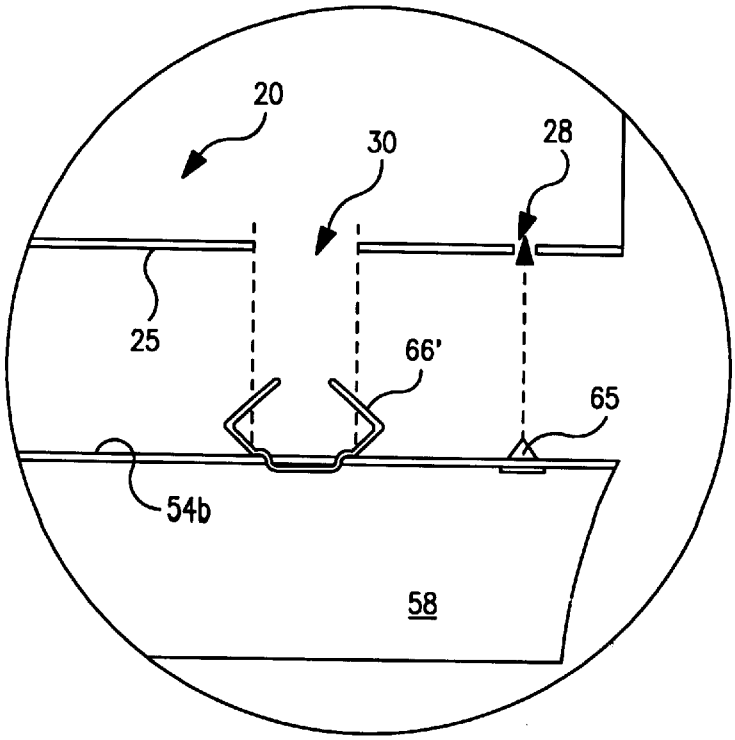
FIG. 5A is a perspective view of the lighting fixture of the present invention showing the reflector having a torsion spring thereon in the form of a spring steel band.

Further, a safety retaining chain 67 having s-clips 68*a* and 68*b* on each end are attached to the ballast housing 20 via retaining slots 32 and cross-bar member 64, respectively, as shown in FIG. 5 of the drawings. Safety retaining chains 67 are used for retaining the reflector pairs 36*a* to 36*c* and 34*a* to 34*e* from falling-off of the lighting fixture 10, in the event of an earthquake.

The second set of reflector pairs 36*a* to 36*c* each include a rectangular reflector unit 70 having a reflector housing 72. Each reflector housing 72, as depicted in FIGS. 2, 3, 4 and 6, includes top perimeter walls 74*a* and 74*b*, a pair of convex-shaped side walls 76 and 78, respectively, and an interior compartment section 84 for holding and housing the lamp ballasts 46 of lamp assemblies 40*a* to 40*c*, respectively. Reflector grid 38 is made from diffuse aluminum, painted aluminum, or colored plastic.

Figure 1:
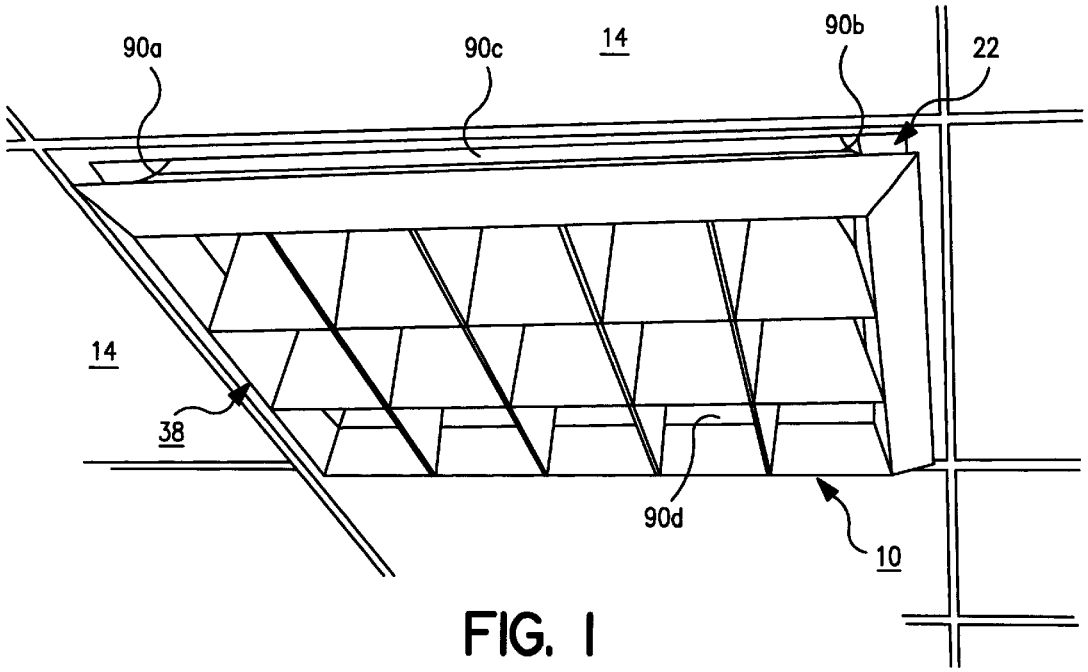
FIG. 1 is a perspective view of the lighting fixture of the preferred embodiment of the present invention showing the reflector grid hanging below the ceiling level in operational use thereof.
Figure 2:
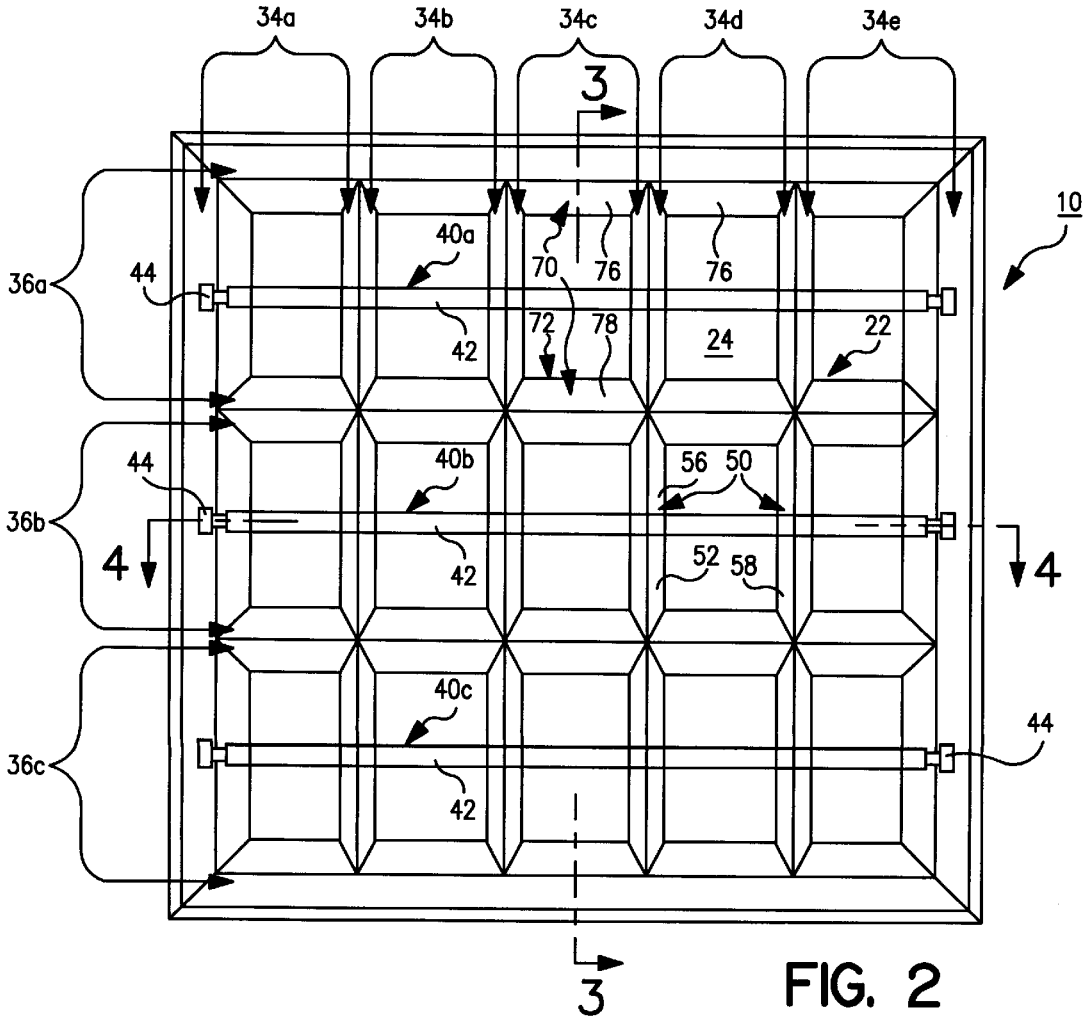
FIG. 2 is a front plan view of the lighting fixture of the present invention showing the plurality of fluorescent lamps within a louver housing, the reflector grid and the direct reflectors thereon.

Ballast housing 20 includes a bottom wall 24, which mounts to back pan 22 that include side walls 26*a* to 26*d* for forming an interior compartment space 27 for mounting therein the plurality of fluorescent lamp assemblies 40*a* to 40*c*, as depicted in FIGS. 2 through 4 of the drawing. Each fluorescent lamp assembly 40*a* to 40*c* includes a fluorescent lamp 42, a lamp socket 44, and a lamp ballast 46. The lamp assemblies 40*a* to 40*c* are electrically coupled with each other via an electrical wiring compartment concealed between the ballast compartment cover 20 and the back pan 22, as depicted in FIGS. 3 and 4 of the drawings. Back pan 22 is made from painted steel. Ballast housing 20 is made from painted steel.

Each of the triangularly-shaped direct/indirect reflectors 90*a* to 90*d* include a convex shaped side wall 92, a bottom wall 94 and a rear wall 96. Rear wall 96 is adjacent and integrally connected to each of the outer side walls 60, 62, 80 and 82, respectively, of the open reflector grid 38, as depicted in FIGS. 3, 4 and 6 of the drawings. Each of the triangularly-shaped reflectors has an angle $\alpha$ in the range of 5° to 30° with a preferred angle $\alpha$ of 15°. Angle $\alpha$ is the angle formed from convex-shaped side wall 92 and rear wall 96, as depicted in FIG. 3 of the drawings. The convex-shaped side wall 92 has a radius of curvature ($r_c$) in the range of 105 mm to 135 mm and an arc angle $\beta$ in the range of 30° to 50°. The indirect reflectors 90*a* to 90*d* are made from mirror-finished aluminum, diffuse aluminum, vacuum-metallized plastic or colored plastic.

Figure 11:
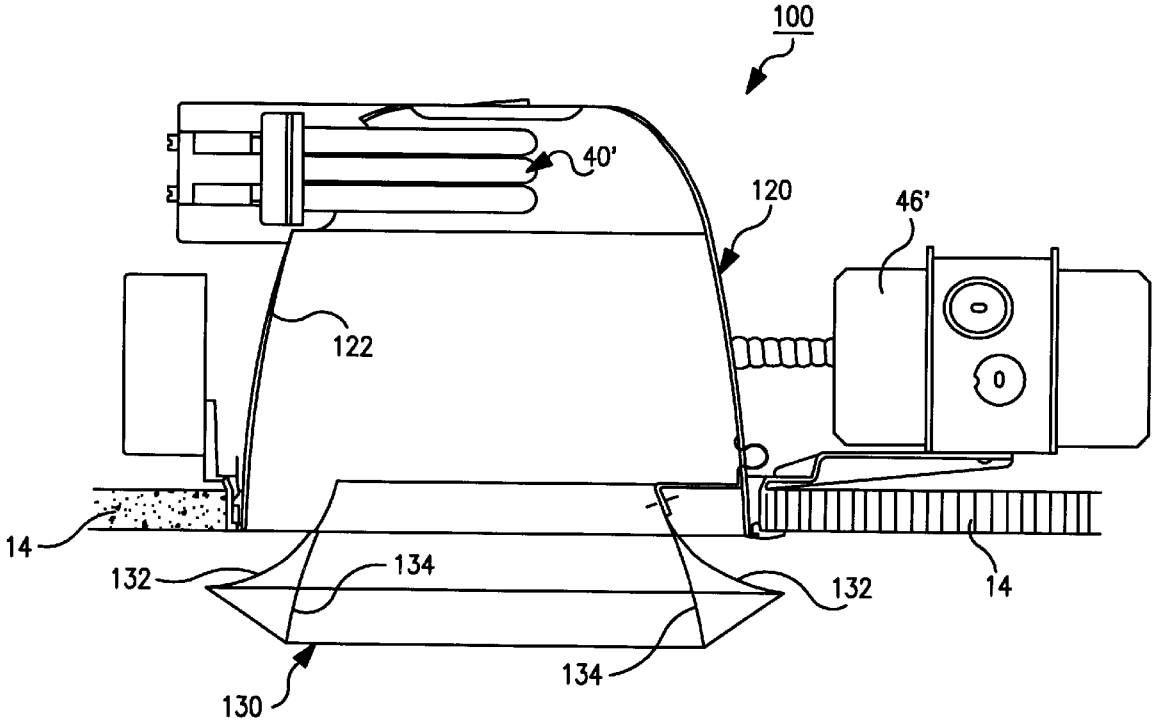
FIG. 11 is a cross-sectional view of the lighting fixture of the alternate embodiment of the present invention showing the circular louver housing, the lamp ballasts, the fluorescent lamps, and the reflector having direct/indirect reflectors thereon.
Figure 12:
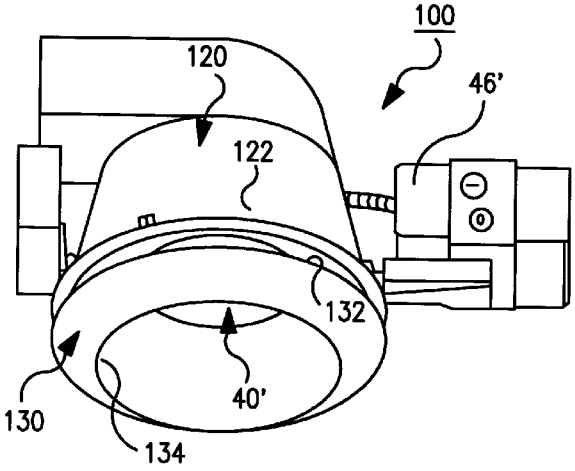
FIG. 12 is a perspective view of the lighting fixture of the alternate embodiment of the present invention showing the circular louver housing, the lamp ballasts, the fluorescent lamp, and the reflectors having direct/indirect reflectors thereon.
Figure 13:
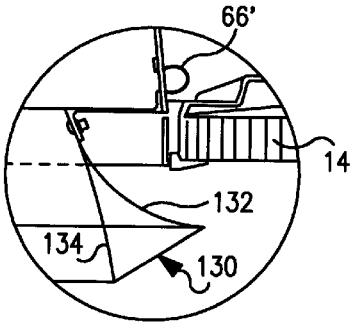
FIG. 13 is an exploded view of the lighting fixture of the alternate embodiment of the present invention showing the secondary reflector being attached to the main reflector body.

The lighting fixture 100 and its component parts of the alternate embodiment of the present invention are represented in detail by FIGS. 11, 12 and 13 of the patent drawings. All aspects of this alternate embodiment 100 are the same as the preferred embodiment of the lighting fixture 10, except for the configuration of the circular main reflector body 120 in the form of a parabolic reflector 122 and a circular reflector 130 having an indirect reflector 132 thereon and a direct reflector 134 thereon.

Operation of the Present Invention

In operating the lighting fixture 10 of the present invention, the user's first step is the installation of the lighting fixture 10 within the plenum space 14s above the ceiling 14, as depicted in FIGS. 1, 3, 4, 9 and 10 of the drawing. The lighting fixture 10 is installed such that the open reflector grid extends at least two inches (2") below the ceiling level 14, as depicted in FIGS. 3 and 4 of the drawings. In this manner, the plenum depth encroachment 14*s* can be greatly reduced giving additional plenum space 14*s* to be further used for additional HVAC ducting within that plenum space 14*s* without any interference with the lighting fixtures 10 that are installed.

Figure 9:
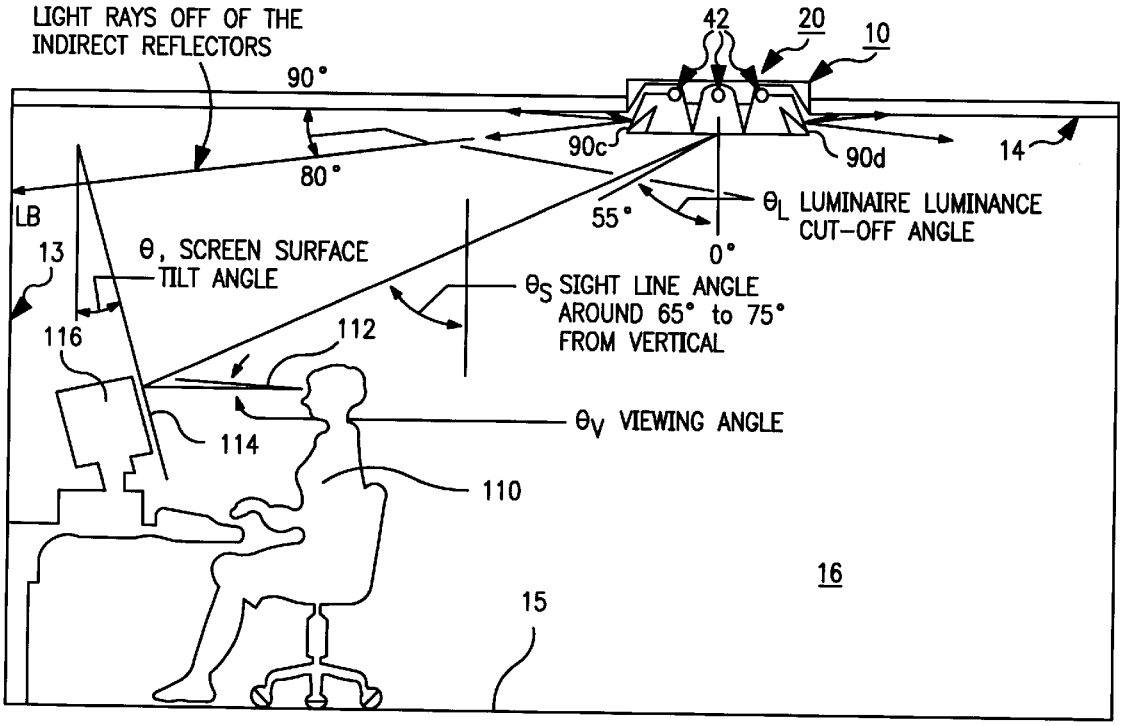
FIG. 9 is a schematic diagram of the lighting fixture of the present invention showing the reduction of glare to a video display terminal (VDT) on a computer monitor to a computer operator using the direct/indirect reflectors on the lighting fixture.
Figure 10:
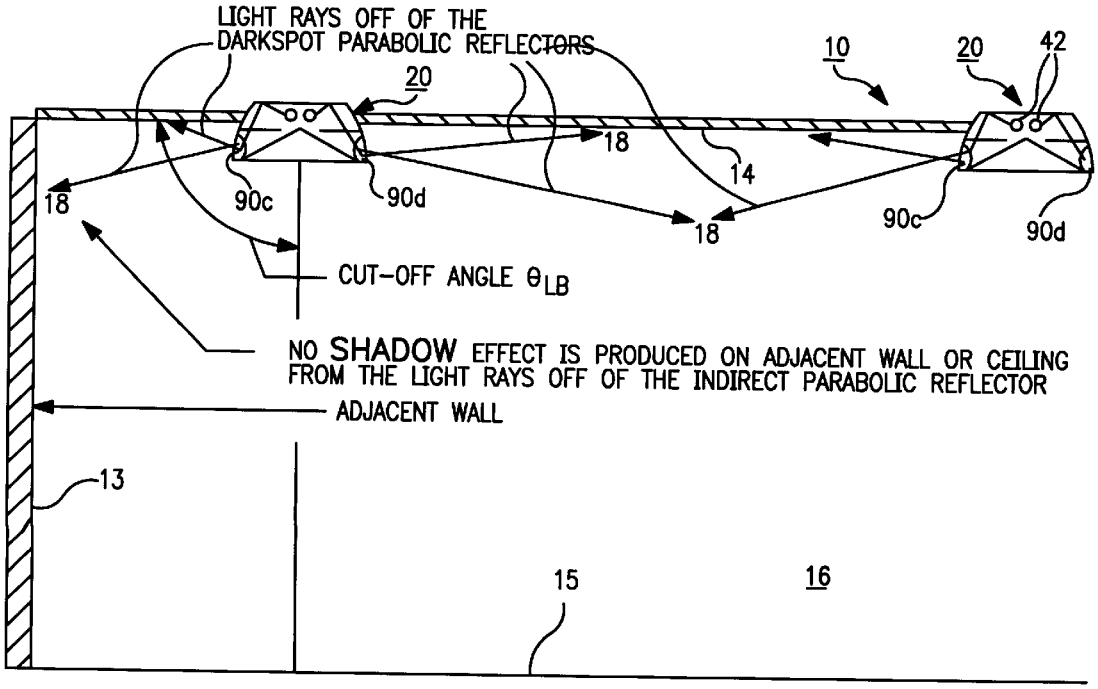
FIG. 10 is a schematic diagram of the lighting fixture of the present invention showing the elimination of wall and ceiling shadows using the indirect reflectors on the lighting fixture.

Additionally, the indirect reflectors 90*a* to 90*d* on the open reflector grid 38 are positioned such that the reflected light rays 18 from the fluorescent lamps 42 are reflected off of the convex surfaces 92 on each of the indirect reflectors 90*a* to 90*d*, respectively, as shown in FIGS. 1, 3, 4, 9 and 10 of the drawings; so that these indirect light rays 18 are focused on the ceiling areas 14 and adjacent walls 13. This results in an increase in the luminaire luminance distribution area above 80° from vertical while maintaining the cut-off angle $\theta_{LB}$ of at least 0° to 55° degrees, and no encroachment in sight line angle $\theta_{SB}$ between 65° to 75° from vertical which produces no apparent shadow effect 12 on the adjacent wall 13 or ceiling 14 within room 16, as well as reduces any glare to equipment within the room 16, including a VDT monitor 114, as depicted in FIGS. 9 and 10 of the drawings.

The prior art, as depicted in FIGS. 7 and 8, shows standard parabolic lighting fixtures having a luminaire luminance cut-off angle $\theta_{LA}$ of 60° degrees so that the resultant reflective light rays 18 give a shadow effect 12 on the walls 13 and ceiling 14. Thus, the present invention of the parabolic lighting fixture 10 having indirect reflectors 90*a* to 90*d* thereon make more efficient use of the direct and indirect light ray reflections 18 from reflectors 90*a* to 90*d* which results in a more uniform room 16 illumination, as shown in FIGS. 9 and 10 of the drawings.

Advantages of the Present Invention

Accordingly, an advantage of the present invention is that it provides for a lighting fixture that gives multi-focus (direct and indirect) lighting to a ceiling, a floor and walls within a room using straight, curved, segmented, stippled or parabolic reflectors having direct/indirect reflectors thereon.

Another advantage of the present invention is that it provides for a lighting fixture having direct/indirect reflectors thereon for reducing energy consumption, for increasing lighting efficiency and for further reducing installation costs.

Another advantage of the present invention is that it provides for a lighting fixture having direct/indirect reflectors thereon that produces uniform lighting within a room.

Another advantage of the present invention is that it provides for a lighting fixture having direct/indirect reflectors thereon that eliminates a cave or shadow effect and/or darkspots on the walls, ceiling or floor of a room.

Another advantage of the present invention is that it provides for a lighting fixture having direct/indirect reflectors thereon that reduces the glare effect caused by the direct and indirect lighting of the fluorescent lamps from conventional lighting methods.

Another advantage of the present invention is that it provides for a lighting fixture having direct/indirect reflectors thereon for increasing work productivity by eliminating the glare on VDT of computer monitors which reduces eye strain and headaches due to the continually focusing and defocusing of the user's eyes on the VDT screen via the cut-off angles and uniformity of the reflective (indirect) light that is given off by the indirect reflectors.

Another advantage of the present invention is that it provides for a lighting fixture having direct/indirect lighting fixture having indirect reflectors thereon that reduces purchase costs over pendant mounted indirect lighting fixtures.

Another advantage of the present invention is that it provides for a lighting fixture having direct/indirect reflectors thereon that reduces plenum depth encroachment, as current HVAC systems utilize a large portion of the above ceiling space which conflicts with conventional lighting fixture placement within the ceiling space area.

Another advantage of the present invention is that it provides for a lighting fixture having direct/indirect reflectors thereon that is compatible with the latest technology in lamp and ballast combinations using tubular fluorescent lamps such as T-8/magnetic and electronic; T-5/electronic; and bi-axial/magnetic and electronic; compact fluorescent/magnetic and electronic; circular fluorescent/magnetic and electronic; and high intensity discharge/magnetic and electronic.

A further advantage of the present invention is that it provides for a lighting fixture having direct/indirect reflectors thereon that can be mass produced in automated and economical manner, and is cost efficient for the user.

A latitude of modification, change, and substitution is intended for the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lighting fixture for reducing glare and darkspots on ceilings and walls, comprising:

a) a louver housing for supporting a plurality of fluorescent or high intensity discharge lamps;

b) a first set of elongated, parallel, and spaced-apart reflector;

c) a second set of elongated, parallel, and spaced-apart reflectors intersecting said first set of reflectors at a 90° degree angle and forming an open reflector grid therein; said open reflector grid having outer side walls connected to the ends of said first and second sets of reflectors and extending along the perimeter of said open reflector grid; said open reflector grid attached to said louver housing;

d) said open reflector grid extending below the ceiling level;

e) a plurality of indirect reflectors connected to said outer side walls of said open reflector grid for reducing glare and darkspots on ceiling and walls caused by the plurality of lamps in said louver housing; and f) said plurality of indirect reflectors extend below the ceiling and reflect light from said indirect reflectors for illuminating the ceiling.

2. A lighting fixture in accordance with claim 1, wherein said reflectors are selected from the group consisting of parabolic, straight, curved, segmented or stippled reflectors.

3. A lighting fixture in accordance with claim 1, wherein said open reflector grid has four outer side walls, and each of said outer side walls is connected to one of said indirect reflectors.

4. A lighting fixture in accordance with claim 1, wherein each of said plurality of indirect reflectors is substantially triangular in shape.

5. A lighting fixture in accordance with claim 1, wherein each of said plurality of indirect reflectors includes one side having a convex-shaped surface.

6. A lighting fixture in accordance with claim 4, wherein said triangular-shaped indirect reflector has an angle $\alpha$ in the range of 5° to 30°.

7. A lighting fixture in accordance with claim 4, wherein said triangular-shaped indirect reflector has an angle $\alpha$ of 15°.

8. A lighting fixture in accordance with claim 5, wherein said convex-shaped surface has a radius of curvature in the range of 105 mm to 135 mm.

9. A lighting fixture in accordance with claim 5, wherein said convex-shaped surface has an arc angle in the range of 30° to 50°.

10. A lighting fixture in accordance with claim 5, wherein said convex-shaped surface reflects light rays from said plurality of fluorescent lamps at a luminaire luminance cut-off angle in a range between 55° or less from the vertical.

11. A lighting figure in accordance with claim 1, wherein said louver housing is made from painted steel with mirror-finished aluminum inserts, diffuse aluminum inserts, and/or vacuum-metallized plastic inserts.

12. A lighting fixture in accordance with claim 1, wherein said parabolic reflector grid is made from mirror-finished aluminum, diffuse aluminum, painted aluminum, vacuum-metallized plastic or colored plastic.

13. A lighting fixture in accordance with claim 1, wherein said indirect reflectors are made from mirror-finished aluminum, diffuse aluminum, painted aluminum, vacuum-metallized plastic or colored plastic.

14. A lighting fixture in accordance with claim 1, further including connecting means for connecting said reflector grid to said louver housing.

15. A lighting fixture in accordance with claim 14, wherein said connecting means includes torsion clips, torsion springs, centering pins, metal fasteners, and combinations thereof.

16. A lighting fixture in accordance with claim 1, wherein said reflectors and housing are circular in shape.

17. A lighting fixture in accordance with claim 1, wherein said open reflector grid extends at least 2" below the ceiling level.

18. A lighting fixture for reducing glare and darkspots on ceilings and walls, comprising:

a) a louver housing for supporting a plurality of fluorescent or high intensity discharge lamps;

b) a first set of elongated, parallel, and spaced-apart reflectors;

c) a second set of elongated, parallel, and spaced-apart reflectors intersecting said first set of reflectors at a 90° degree angle and forming an open reflector grid therein; said open reflector grid having outer side walls; said open reflector grid attached to said louver housing;

d) said open reflector grid extending below the ceiling level;

e) a plurality of indirect reflectors connected to said outer side walls of said open reflector grid for reducing glare and darkspots on ceiling and walls caused by the plurality of lamps in said louver housing; and f) said plurality of indirect reflectors includes one side having a convex-shaped surface; said convex-shaped surface has a radius of curvature in the range of 105 mm to 135 mm.

19. A lighting fixture for reducing glare and darkspots on ceilings and walls, comprising:

a) a louver housing for supporting a plurality of fluorescent or high intensity discharge lamps;

b) a first set of elongated, parallel, and spaced-apart reflectors;

c) a second set of elongated, parallel, and spaced-apart reflectors intersecting said first set of reflectors at a 90° degree angle and forming an open reflector grid therein; said open reflector grid having outer side walls; said open reflector grid attached to said louver housing;

d) said open reflector grid extending below the ceiling level;

e) a plurality of indirect reflectors connected to said outer side walls of said open reflector grid for reducing glare and darkspots on ceiling and walls caused by the plurality of lamps in said louver housing; and f) said reflectors and housing are circular in shape.

* * * * *